US007047881B2

(12) United States Patent
Schaede

(10) Patent No.: US 7,047,881 B2
(45) Date of Patent: May 23, 2006

(54) NOZZLES FOR A CLEANING INSTALLATION OF A PRINTING MACHINE

(75) Inventor: Johannes Georg Schaede, Würzburg (DE)

(73) Assignee: KBA-GIORI S.A., Lausanne (CH)

( * ) Notice: Subject to any disclaimer, the term of this patent is extended or adjusted under 35 U.S.C. 154(b) by 0 days.

(21) Appl. No.: 10/512,707

(22) PCT Filed: Apr. 30, 2003

(86) PCT No.: PCT/IB03/01770

§ 371 (c)(1),
(2), (4) Date: May 11, 2005

(87) PCT Pub. No.: WO03/093011

PCT Pub. Date: Nov. 13, 2003

(65) Prior Publication Data

US 2005/0199148 A1 Sep. 15, 2005

(30) Foreign Application Priority Data

May 6, 2002 (EP) ..... 02405369

(51) Int. Cl.
*B41F 35/00* (2006.01)

(52) U.S. Cl. ..... 101/424; 101/425

(58) Field of Classification Search ..... 101/423–425; 15/256.5, 256.51, 256.52; 399/34, 123, 343; 134/151, 153

See application file for complete search history.

(56) References Cited

U.S. PATENT DOCUMENTS

| | | | | |
|---|---|---|---|---|
| 4,185,399 | A * | 1/1980 | Gladish | 34/120 |
| 4,236,450 | A | 12/1980 | Bonomi | 101/425 |
| 4,852,209 | A * | 8/1989 | Svenka et al. | 15/308 |
| 5,074,211 | A * | 12/1991 | Loos et al. | 101/425 |
| 5,390,598 | A | 2/1995 | Stauffer | 101/167 |
| 5,484,482 | A * | 1/1996 | Rantanen et al. | 118/203 |
| 5,660,196 | A * | 8/1997 | Bein | 134/129 |
| 5,855,787 | A | 1/1999 | Giori | 210/651 |
| 6,485,653 | B1 | 11/2002 | Martini | 210/723 |
| 6,691,719 | B1 * | 2/2004 | Ko et al. | 134/148 |

FOREIGN PATENT DOCUMENTS

| | | |
|---|---|---|
| DE | 967 808 | 4/1952 |
| EP | 0 927 632 A1 | 7/1999 |

* cited by examiner

*Primary Examiner*—Anthony H. Nguyen
(74) *Attorney, Agent, or Firm*—Crompton, Seager & Tufte, LLC

(57) ABSTRACT

The nozzle has a channel (24) in which a cleaning solution is injected under pressure, and an outlet (26) through which the solution is sprayed against a cylinder. The outlet (26) is formed by a first part (23) and a second part (25), said second part (25) being movable with respect to said first part (23) in order to vary the size of said outlet (26).

10 Claims, 3 Drawing Sheets

Fig.2
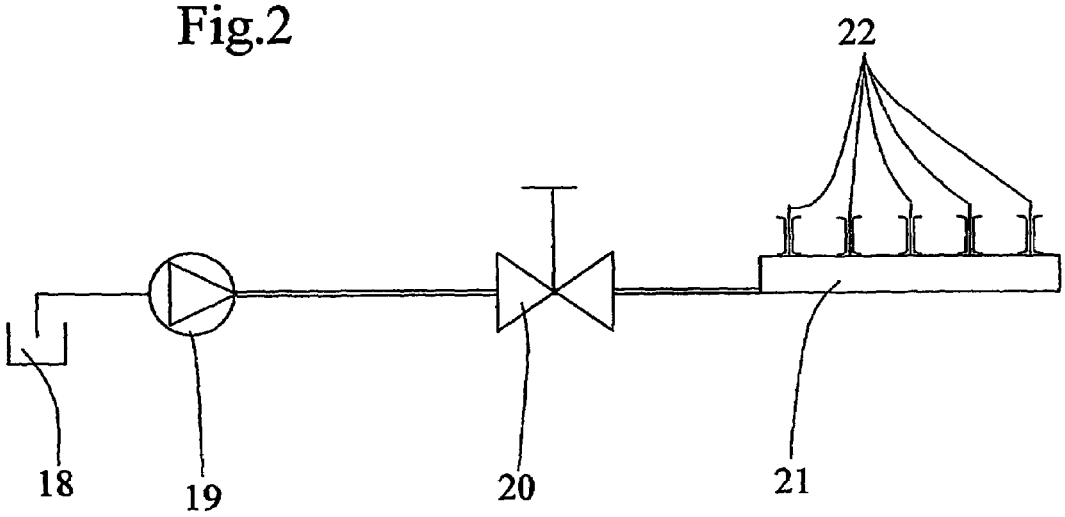
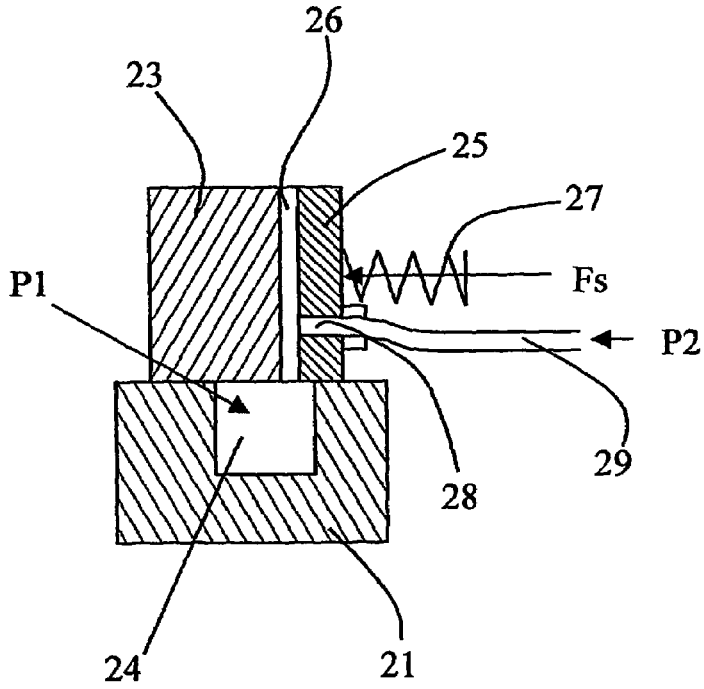
Fig.3

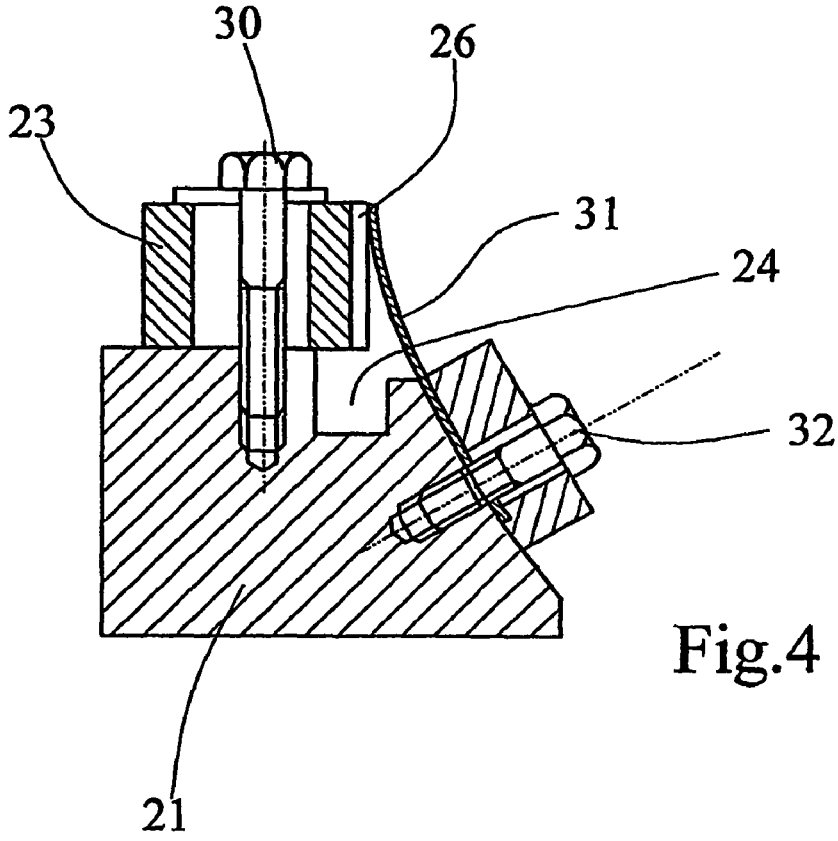
Fig.4
Fig.5
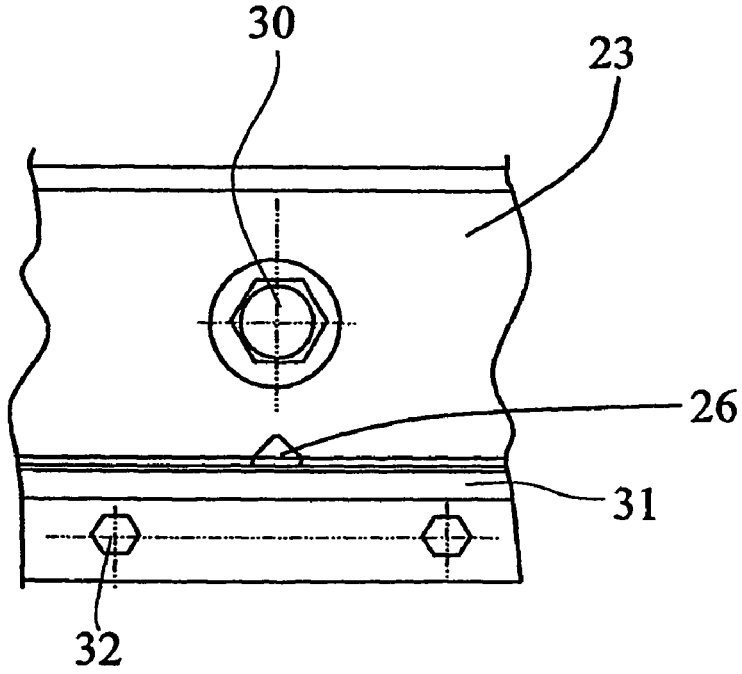

NOZZLES FOR A CLEANING INSTALLATION OF A PRINTING MACHINE

FIELD OF THE INVENTION

The present invention concerns a nozzle for a cleaning installation used to clean the wiping cylinder of a printing machine.

BACKGROUND OF THE INVENTION

Cleaning installations for printing machines are known in the art. For example, U.S. Pat. No. 5,390,598 discloses a wiping device for an intaglio printing machine comprising a wiping cylinder and an installation for the continuous cleaning of said cylinder. The principle and basic technical features of the wiping device as disclosed in this patent are incorporated by reference to the present application. The installation comprises a container for receiving the cleaning liquid which continuously acts on the wiping cylinder and cleaning elements in contact with the periphery of the wiping cylinder comprising, in the direction of rotation of the cylinder, brushes and/or wiping blades and at least a row of nozzles parallel to the axis of the wiping cylinder, the nozzles being arranged to eject the cleaning liquid into the region of contact of the cleaning elements with the wiping cylinder. There may be one or several rows of spray nozzles, which send a cleaning solution under pressure. Known cleaning solutions are disclosed for example in U.S. Pat. No. 5,855,787 or in European patent application No. 0 927 632, the content of which is incorporated by reference in the present application.

U.S. Pat. No. 4,236,450 discloses another cleaning installation for the continuous cleaning of a wiping roller of a printing machine, the principles of which are incorporated by reference in the present application. This installation is characterized in that it comprises at least two rows of nozzles arranged parallel to the axis of the wiping roller, the nozzles spraying the cleaning solution onto the surface of the wiping cylinder. An example of a nozzle disclosed in this patent comprises a plate pressed against a wall of a support, said plate comprising small grooves in order to spray a continuous film of liquid. All the rows of nozzles are connected to pumps, which supplies them with cleaning liquid.

In another embodiment known in the art, the nozzles are made of a shaft of rectangular section comprising an inner channel parallel to the axis of the shaft, in which the wiping solution is sent under pressure, and an array of holes forming the nozzles, which are formed on the side of the shaft facing the wiping roller. Said holes are in communication with said channel in order for the solution to be sprayed against the wiping roller with a given pressure.

The problem encountered in the known installations is the fact that the nozzles, which have a small diameter, may be blocked or obturated by particles present in the cleaning solution so that the cleaning effect is reduced. In such case, it becomes necessary to stop the printing machine, remove the wiping cylinder to gain access to the shafts with the nozzles and to remove said shafts from the machine to be able to clean the nozzles in a remote place. Once this has been done, the shafts must be assembled and adjusted in the machine and then only can the wiping cylinder brought back in position. All these operations are time consuming and, since the machine is not working anymore, they have an important cost.

SUMMARY OF THE INVENTION

It is therefore an object of the present invention to improve the known installations.

Another aim of the invention is to provide a cleaning installation that is easy to clean in the event of an obturated nozzle.

Another aim of the invention is to provide an improved nozzle design that may be cleaned in a simple an effective manner.

A nozzle according to the invention is defined in independent claim 1 of the present application.

Dependent claims 2 to 5 define particular embodiments of the nozzle according to the invention.

Claim 6 and 7 define a cleaning installation comprising nozzles according to the invention.

Independent claim 8 defines a printing machine comprising a cleaning installation according to the invention.

BRIEF DESCRIPTION OF THE DRAWINGS

The invention will be best understood with the description of several embodiments and the accompanying drawings in which:

FIG. 2 shows the principle of an array of cleaning nozzles.

FIG. 3 shows the principle of a nozzle according to the invention.

FIG. 4 shows an embodiment of a nozzle according to the invention.

FIG. 5 shows a top view of the nozzle of FIG. 4.

DETAILED DESCRIPTION OF THE EMBODIMENTS

Figure 1:
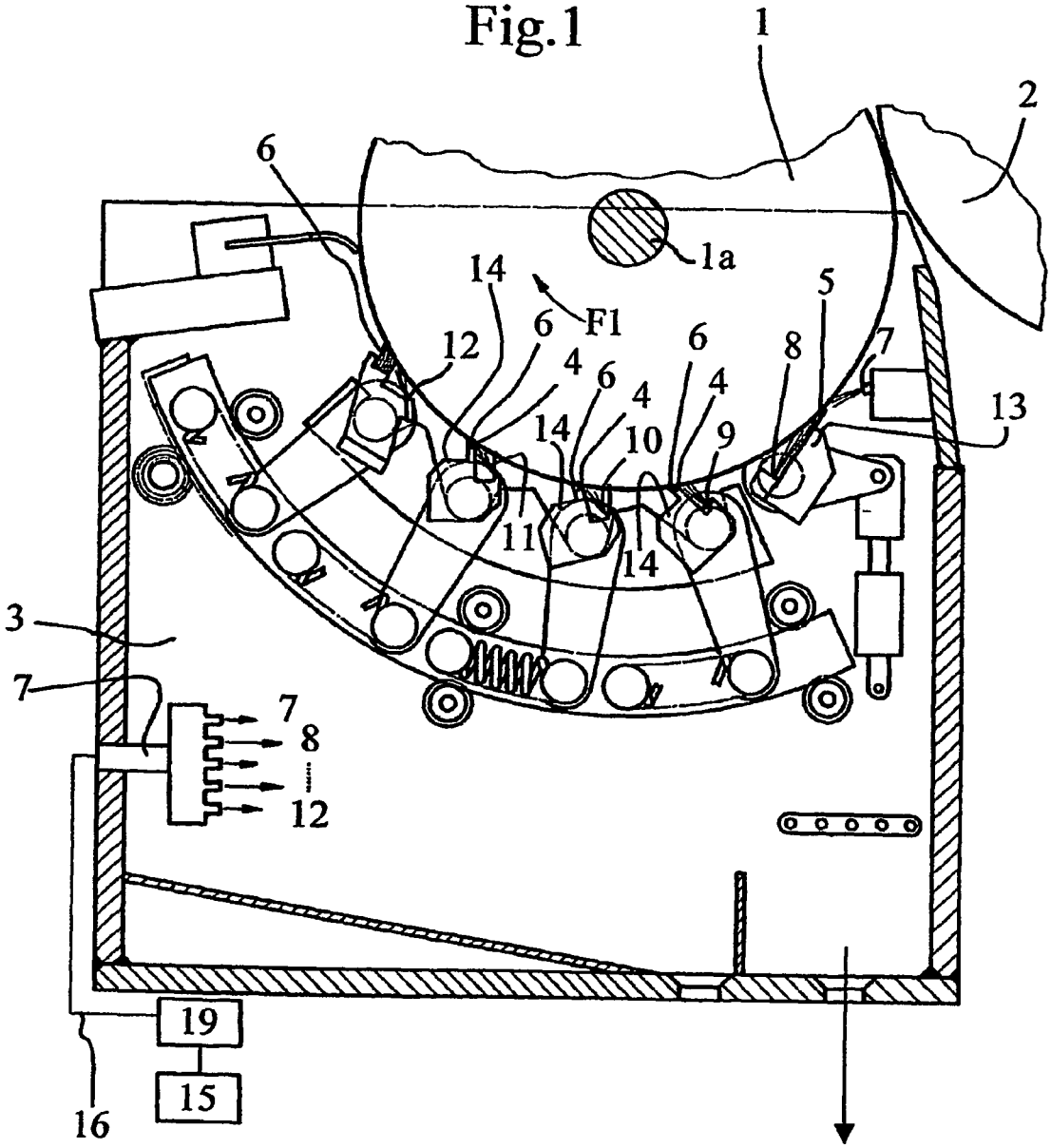
FIG. 1 discloses a diagrammatic side view, partly in section, of a wiping installation in a printing machine.

The installation represented in FIG. 1, as an example of a cleaning installation, corresponds to the one disclosed in U.S. Pat. No. 4,236,450, the description of which is incorporated by reference in the present application. In this installation, a wiping roller 1 rotating about a shaft 1*a* in the direction of the arrow F1 is in contact with a plate-supporting cylinder 2 of a printing machine. The wiping roller 1 is located partly inside a container 3 in which the cleaning installation is mounted. This installation comprises also several cleaning members formed by scrapers 4, 5 and brushes 6. The cleaning members extend over the entire length of the wiping roller 1 and act on its periphery to remove the major part of the ink mechanically from the periphery of this roller. The installation comprises also rows of nozzles 7, 8, 9, 10, 11 and 12 parallel to the axis of the wiping roller 1 for ejecting a cleaning solution, such as disclosed for example in U.S. Pat. No. 5,855,787 or in European patent application No. 0 927 632, onto the periphery of the roller 1 in front of the area of the scrapers 4, 5 and of brushes 6 which are in contact with the roller 1.

The first row of nozzles 7 (according to the direction of rotation of the roller 1) is located in front of the first scraper 5 making it possible to wet the wiping roller with a continuous film of cleaning solution. The first scraper 5 removes approximately 95% of the mass of ink adhering to the surface of the wiping roller and in order that the particles of ink do not accumulate behind this scraper 5, the second row of nozzles 8 is mounted on a scraper support 13 behind said scraper 5. The other rows of nozzles 9 to 12 are mounted on the scraper supports 14. The rows of nozzles 7 to 12 are connected to the outlet of pump 19, which supplies them with cleaning solution coming from source 15 through pipe 16 and distributor 17 feeding the rows of nozzles 7–12 with the cleaning solution.

The principle of an array of nozzles as used in the installation of FIG. 1 and according to the invention is described with reference to FIG. 2. The system comprises preferably a tank 18 of cleaning solution, corresponding to the source 15 of FIG. 1, with a pump 19, a valve 20 and a distributing shaft 21 supporting an array of nozzles 22.

The principle of a nozzle according to the invention is described more specifically with reference to FIG. 3. The nozzle comprises a first part 23 attached to the distributing shaft 21 in which the cleaning solution is brought under pressure P1 in the channel 24. The nozzle comprises a second part 25, which is mobile with respect to the first part 23, the relative position of said mobile part 25 with respect to the first part 23 defining the outlet channel 26 of the cleaning solution. The mobile part 25 is pressed against the first part 23, which is schematised by spring 27 producing force Fs. Under working conditions, the cleaning solution is brought under a given pressure P1 by pump 19 in the channel 24, and this pressure is sufficient to counteract the force Fs of the spring, thus opening the outlet 26 until the forces are balanced between pressure P1 and force Fs.

If the outlet 26 is blocked by particles, then one increases the pressure P1 of the cleaning solution by pump 19 in order to push the mobile part 25 against the spring element 27 outwards thus increasing the size of the outlet 26, which then allows the blocking particles to be ejected from the nozzle, by combination of higher pressure and increased outlet size.

Such a procedure may be carried out on a regular basis, after a certain time, or in case of an effective blockage of one or several nozzles.

Preferably, the first part 23 comprises stopping means for the mobile part 25 so that the outlet 26 is never closed but retains its working size when no cleaning solution is injected. Accordingly, when a cleaning solution is injected under pressure P1, the mobile part 25 does not move since the outlet 26 already has its working size. Only when the pressure is increased, for example to clean the nozzles, is mobile part 25 displaced thus increasing the size of the outlet 26 until the forces created by the increased pressure of cleaning solution and the spring 27 element are balanced.

Further, the nozzle may comprise additional cleaning means in the shape of a cleaning opening 28 which receives for example air under pressure at a pressure P2 through compressed air supply 29 which then is mixed to the cleaning solution exiting from channel 24. This combination brings a more effective cleaning system with the combination of cleaning solution and air.

An embodiment of a nozzle according to the invention is described with reference to FIGS. 4 and 5. The nozzle comprises said first part 23 mounted, for example with a screw 30, on the distributing shaft 21 with a channel 24 for delivering the cleaning solution. This part of the nozzle may be made of two different parts attached together (shaft 21 and part 23), as described here above, or in one single piece.

The first part 23 comprises an outlet 26 through which the cleaning solution is injected against the wiping roller according to the principle of the invention (see FIG. 1). The nozzle further comprises an elastic blade 31 corresponding to the mobile part 25 of FIG. 3. The blade 31 is mounted on the shaft 21 as shown by a screw 32 or other equivalent means. As shown in FIG. 5, a top view of FIG. 4, when no cleaning solution is injected through outlet 26 or when the solution is injected at working pressure, the blade 31 forms the nozzle which has been shaped in first part 23, by remaining in contact with said first part 23. When it becomes necessary to clean a nozzle or several nozzles, the pressure of the cleaning solution for the wiping cylinder 1 is increased thus increasing the size of the outlet 26 by moving blade 31 away of first part 23.

As represented in FIG. 3, the nozzle of FIG. 4 may comprise additional cleaning means 28, 29 bringing air under pressure in the nozzle which is mixed to the cleaning solution.

Several nozzles as the one disclosed in FIGS. 4 and 5 may be mounted on the shaft 21, as represented schematically in FIG. 2, forming an array of cleaning nozzles.

Such a shaft 21 with an array of nozzles may be then mounted in the installation represented in FIG. 1. In this installation of FIG. 1, several parallel shafts 21 would then be placed next to each other with their longitudinal axis parallel to the shaft 1*a* supporting the wiping cylinder 1, as the represented nozzles 7–12, thus spraying the cleaning solution on the entire length of the wiping cylinder 1. This forms a cleaning installation suitable for a printing machine, schematically represented in FIG. 1.

The embodiment disclosed in the present application are given by way of example are not interpreted as limiting the scope of the claims.

The invention claimed is:

1. A cleaning installation for a printing machine comprising at least one distributing shaft supporting an array of nozzles for cleaning a wiping cylinder of the printing machine, each nozzle having a channel in which a cleaning solution is injected under pressure, and an outlet through which the solution is sprayed against the cylinder, wherein the outlets of said nozzles are formed by a first part, which is mounted on or which is part of the distributing shaft, and by a second part which is movable with respect to said first part in order to vary the size of said outlet and allow a cleaning of said array of nozzles by moving said second part away of said first part.

2. A cleaning installation according to claim 1, wherein said second part is pressed against said first part by elastic means.

3. A cleaning installation according to claim 1, wherein said second part is formed by a blade.

4. A cleaning installation according to claim 3, wherein said blade is an elastic blade mounted on said distributing shaft.

5. A cleaning installation according to claim 3, wherein said outlets are shaped in said first part and in that said blade forms said nozzles by remaining in contact with said first part when no cleaning solution is injected into the channel or when the solution is injected at a working pressure.

6. A cleaning installation according to claim 3, wherein each nozzle comprises additional cleaning means for the nozzle.

7. A cleaning installation according to claim 6, wherein said additional means comprises a cleaning nozzle sending air under pressure in said nozzle.

8. A cleaning installation according to claim 6, characterised in that it comprises several distributing shafts, each supporting an array of nozzles.

9. A printing machine comprising a cleaning installation as claimed in claim 1.

10. A cleaning installation according to claim 4, wherein said outlets are shaped in said first part and in that said blade forms said nozzles by remaining in contact with said first part when no cleaning solution is injected into the channel or when the solution is injected at a working pressure.

* * * * *